US005197542A

United States Patent [19]

Coone

[11] Patent Number: 5,197,542

[45] Date of Patent: Mar. 30, 1993

[54] WELL PACKER

[75] Inventor: Malcolm G. Coone, Katy, Tex.

[73] Assignee: Davis-Lynch, Inc., Pearland, Tex.

[21] Appl. No.: 861,299

[22] Filed: Mar. 31, 1992

[51] Int. Cl.[5] ..... E21B 33/127; E21B 33/128

[52] U.S. Cl. ..... 166/122; 166/134; 166/187; 277/34

[58] Field of Search ..... 166/187, 122, 134; 277/34, 34.3, 34.6

[56] References Cited

U.S. PATENT DOCUMENTS

| | | | |
|---|---|---|---|
| 2,738,017 | 3/1956 | Lynes | 166/187 X |
| 2,738,018 | 3/1956 | Lynes | 166/187 X |
| 3,524,503 | 8/1970 | Baker | 166/289 |
| 4,052,861 | 10/1977 | Malone et al. | 61/86 |
| 4,063,427 | 12/1977 | Hoffman | 61/100 |
| 4,349,204 | 9/1982 | Malone | 277/34 |
| 4,768,590 | 9/1988 | Sanford et al. | 166/187 |
| 4,832,120 | 5/1989 | Coronado | 166/187 |
| 4,892,144 | 1/1990 | Coone | 166/122 |
| 4,979,570 | 12/1990 | Mody | 166/187 X |
| 5,027,894 | 7/1991 | Coone et al. | 166/122 |
| 5,101,908 | 4/1992 | Mody | 166/187 X |

OTHER PUBLICATIONS

Baker Service Tools Brochure Entitled "LYNES TM XL ECPs".

Completion Tool Company Pamphlet Entitled "Payzone TM Packer Installation & Evaluation".

*Primary Examiner*—Hoang C. Dang

*Attorney, Agent, or Firm*—Vaden, Eickenroht, Thompson, Boulware & Feather

[57] ABSTRACT

There is disclosed a well packer for use in closing off the annulus between a casing string in which the packer is connected and a well bore into which the casing string is lowered. The packer includes a mandrel connected as part of the casing string, a sleeve of elastomeric material surrounding an intermediate portion of the mandrel and adapted to be inflated into engagement with the well bore, and relatively short, substantially rigid but flexible, overlapping strips disposed about only upper and lower portions of the sleeve for expansion therewith into engagement with the well bore.

3 Claims, 3 Drawing Sheets

WELL PACKER

This invention relates generally to a packer which is connected as part of a well casing string for use in closing off the annulus between the well casing and a well bore in which it is suspended. More particularly, it relates to an improved packer of the general type in which a sleeve of elastomeric material is adapted to be inflated into engagement with a length of the well bore which is substantial relative to the diameter of the well bore.

As well known in the art, packers of this general type comprise a tubular mandrel which is adapted to be connected as part of the casing string for lowering therewith to a desired level in the well bore and which has a head at both ends, a sleeve of elastomeric material surrounding an intermediate portion of the mandrel and anchored at its ends to the upper and lower heads, and means by which fluid under pressure may be supplied to the annulus between the intermediate portion of the mandrel and sleeve in order to inflate the sleeve into engagement with the well bore and then hold it so engaged. There are occasions in which the operator of the well wants such a packer which has a relatively long sleeve capable of closing off a length of the well bore which is long relative to its diameter. This may be desirable, for example, in closing off intervals between vertically spaced production zones in the well bore. Alternatively, it may be desired to close off an entire zone to isolate it from other zones by inflating the sleeve with cement and then perforating the zone through the set cement.

In any event, difficulties have been encountered in causing the elastomeric sleeve to inflate throughout its length, and thus preventing the formation of voids or pockets opposite certain areas of the well bore. It has therefore been proposed to vary the durometer of the rubber of the sleeve to cause it to inflate progressively from the bottom up. It has also been proposed to provide a mechanical barrier to prevent flow past the ends of the inflated sleeve by means of upper and lower sets of relatively short lengths of substantially flat, relatively rigid but flexible, overlapping metal strips which are anchored at their upper and lower ends to the upper and lower heads, respectively, in surrounding relation to only upper and lower portions of the sleeve. Although the use of relatively short sets of strips about upper and lower portions of the sleeve are useful as a barrier, there is no assurance that, during inflation, the ends of the sleeves will not tend to fold back against the mandrel.

U.S. Pat. No. 4,892,144, assigned to the assignee of the present application, shows a packer having an inflatable sleeve of more conventional length and strips of the type above described which are anchored at their upper and lower ends to the upper and lower heads, respectively, to surround the sleeve throughout its entire length. Since the strips are not separated intermediate their lengths, one or both of the heads must be free to move relative to the remainder of the mandrel as the strips are forced against the well bore with the sleeve.

In some versions of this latter packer, only certain portions of the strips are covered by outer layers of elastomeric material, and the outer surfaces of the uncovered portions of the strips are provided with means for gripping the well bore as the strips are expanded upon inflation of the sleeve. In one embodiment of the packer, the grippers are formed on outer surfaces of the strips above the outer layer and are arranged as to resist upward movement of the packer when set. In another embodiment, they are formed on the outer surface of the strips above and below an intermediate outer layer of elastomeric material and so formed as to resist either upward or downward movement of the set packer. In still another embodiment, the grippers are formed on outer surfaces of the strips intermediate upper and lower outer sleeves, with some formed to prevent upward movement and others to prevent downward movement of the set packer.

Although the grippers on the strips of at least one embodiment of the packer in the aforementioned patent might resist the tendency of the ends of the sleeve to fold back, the packer is nevertheless particularly ill suited for accomplishing the purposes of the present invention —namely, a relatively long sleeve for closing off a space in the well bore of substantial length relative to the diameter of the bore. For one thing, the full length of the strips would inhibit initial expansion of the mid portion of the sleeve against the well bore. Also, the long lengths of the strips, and the need for anchoring them to movable heads, at least on one end, would greatly increase the cost of manufacture of the packer.

U.S. Pat. No. 5,027,894, also assigned to the assignee of the present application, shows a particular type of packer known as a "through the tubing bridge plug" wherein, upon expansion, the ends of an inflatable sleeve are constrained by grippers about upper and lower sets of overlapping reinforcing strips. However, because of its special requirements, the strips are not anchored to heads at the ends of a mandrel so as to be expanded with the sleeve, and the packer is otherwise of more complicated and expensive construction than would otherwise be necessary for accomplishing the purposes of this invention.

U.S. Pat. No. 3,524,503 relates to a more conventional packer in which the ends of the inflatable sleeve are surrounded by metal rings having spaced fingers which have grippers on their outer sides which are expanded with the sleeve. However, the fingers of the ring do not overlap one another and hence do not reinforce the sleeve in the sense of the overlapping strips of the other packers above described.

It is therefore the object of this invention to provide a long packer of the type first described which is of simple and inexpensive construction including reinforcing overlapping strips which act to anchor the upper and lower portions of the inflatable sleeve as the sleeve expands.

These and other objects are accomplished, in accordance with the illustrated and preferred embodiment of the invention, by a packer which comprises, as in prior packers of this general type, a tubular mandrel adapted to be connected as part of the casing string and having a head at each end, a sleeve of elastomeric material surrounding the mandrel and anchored at its upper and lower ends to the upper and lower heads, respectively, and means by which fluid under pressure may be introduced into the annular space between an intermediate portion of the mandrel and sleeve so as to inflate the sleeve into engagement with the well bore. In accordance with one novel aspect of the present invention, the packer further includes upper and lower sets of substantially flat, relatively rigid, overlapping strips having their upper and lower ends, respectively, anchored to the upper and lower heads, and extending from the heads for disposal about only upper and lower portions of the sleeve, and with the free ends of the strips being covered by an outer layer of the sleeve. More particularly, the uncovered portions of both sets of strips are provided with means on their outer surfaces for gripping the well bore, following inflation of the mid portion of the sleeve intermediate the free ends of the strips against the well bore. This then prevents the upper and lower portions of the sleeve from being folded back over the ends of the mandrel, as might occur, for example, if it were not for the gripping of the well bore by the strips surrounding these portions of the sleeve.

As illustrated, the mandrel includes inner and outer tubular members which form an annular recess in the head in which the ends of the sleeve and strip are anchored, and layers of elastomeric material covering the strips between the upper and lower heads and their upper and lower uncovered portions. The mid portion of the sleeve intermediate the free ends of the strips also preferably includes an outer layer of elastomeric material which engages the well bore prior to the gripping means. The sleeve is preferably inflated by means of a passageway in the mandrel connecting the bore of the mandrel with the annular space between an intermediate portion of the mandrel and the sleeve, and valve means in the passageway which permits fluid to flow into the space to inflate the sleeve and then hold the fluid in the space to maintain the sleeve expanded.

In the drawings, wherein like reference characters are used through designate right like parts:

Figure 1A:
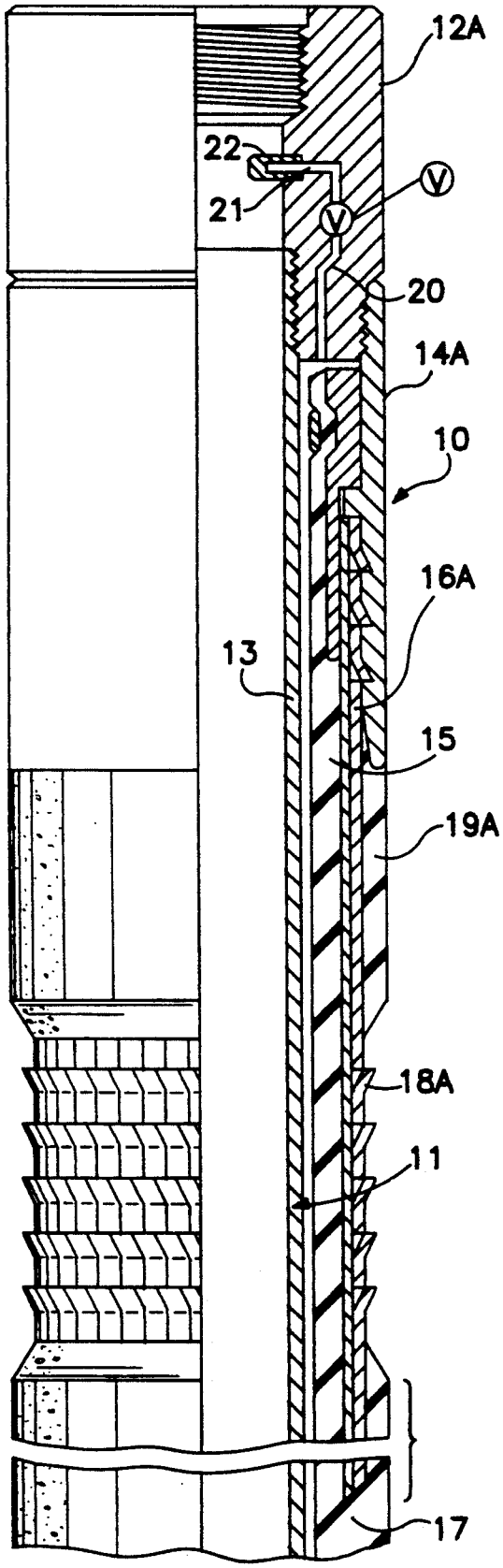
FIGS. 1A and 1B are views, partly in elevation and partly in vertical section, of the upper and lower ends, respectively, of the packer, with both ends being interrupted intermediate their lengths.
Figure 1B:
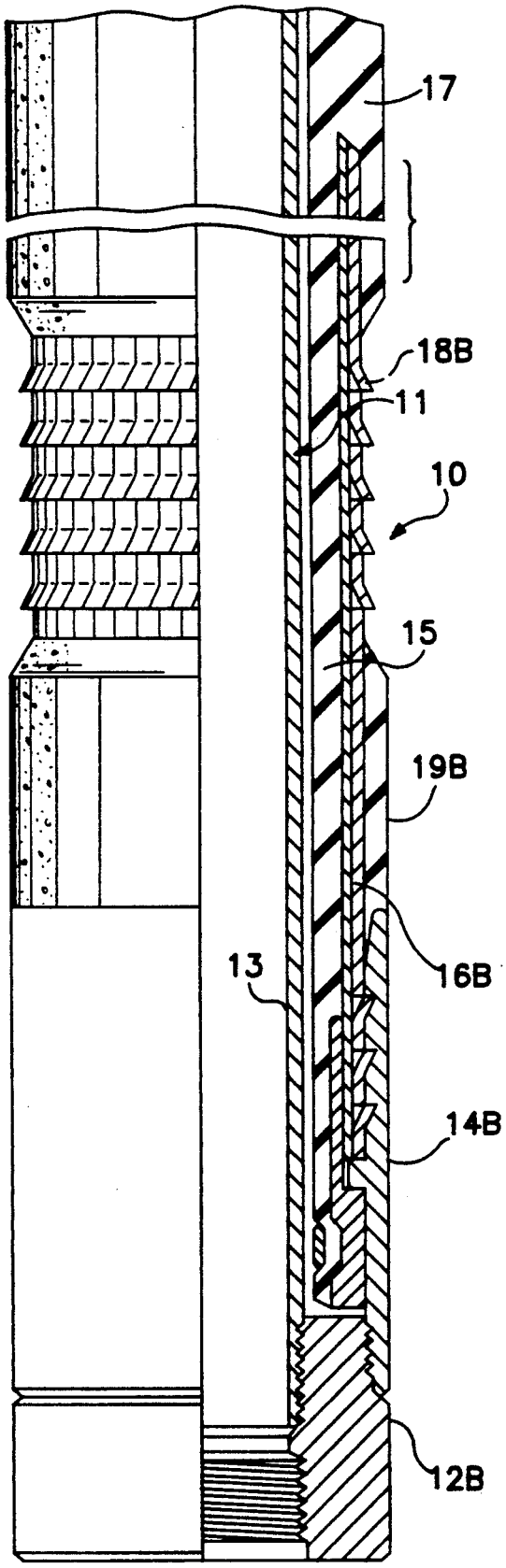

With reference now to the details of the above described drawings, the over-all packer, which is indicated in its entirety by reference character 10, is shown in FIGS. IA and IB to comprise a tubular mandrel 11 adapted to be connected as part of a casing string for lowering therewith into the well bore. More particularly, the mandrel comprises upper and lower subs 12A and 12B threaded for connection to adjacent upper and lower joints of the casing string, an inner tubular member 13 connected at its opposite ends to the heads to form the bore through the mandrel, and outer tubular members 14A and 14B threadedly connected to the subs 12A and 12B, respectively, in spaced relation about the upper and lower ends of the tubular member 13 to form upper and lower heads having annular recesses between them.

The packer also includes a sleeve 15 of elastomeric material which surrounds the sleeve 13 of the mandrel and whose upper and lower ends extend within the annular recesses in the heads for anchoring thereto by suitable means, as for example in a manner similar to that shown and described in the aforementioned U.S. Pat. No. 4,892,144. Alternatively, and in accordance with the broad aspects of the present invention, the upper and lower ends of the sleeve may be otherwise anchored, as by means of adhesives within the recesses.

The packer further includes only upper and lower sets of metal strips 16A and 16B which surround only upper and lower portions of the sleeve 15 for relatively short distances as compared with the over-all length of the sleeve. Thus, for example, the sleeve may be 20 feet or more in length for closing off the annular space between a casing string and a well bore of 5 to 25 inches in diameter. The upper ends of the strip 16A and the lower ends of the strip 16B are anchored within the annular recesses of the upper and lower heads, respectively, by means which, as illustrated, is also similar to that also shown and described in the aforementioned U.S. Pat. No. 4,892,144. Again, however, the invention contemplates that, in accordance with its broader aspects, the ends of the strips may be otherwise anchored in the heads.

In any event, and in accordance with the novel aspects of the present invention, the free ends of the relatively short lengths of the sets of strips are surrounded by and thus embedded in a layer 17 of elastomeric material which also forms an enlarged diameter mid portion of the sleeve intermediate the ends of the strips. This mid portion is free to expand outwardly into engagement with the well bore upon inflation prior to engagement therewith of the strips.

Figure 2:
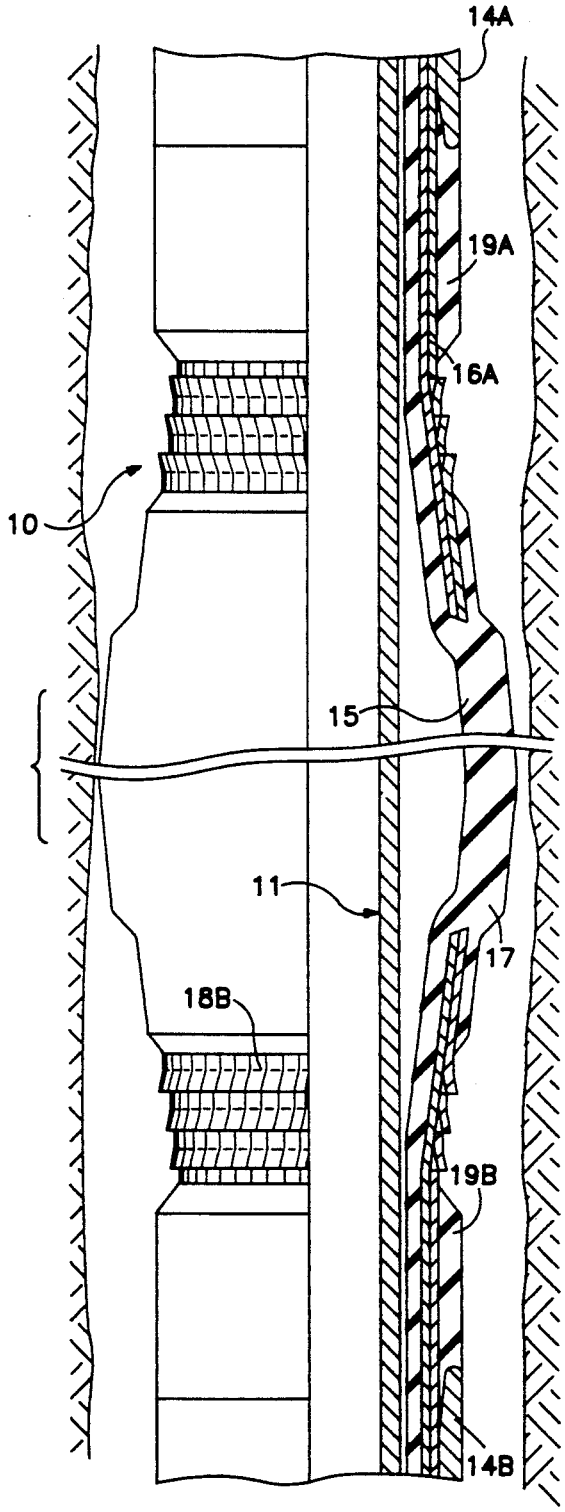
FIG. 2 is another view, partly in elevation and partly in vertical section, of a mid portion of the packer during the preliminary inflation of the sleeve toward the well bore in which the packer is disposed.
Figure 3:
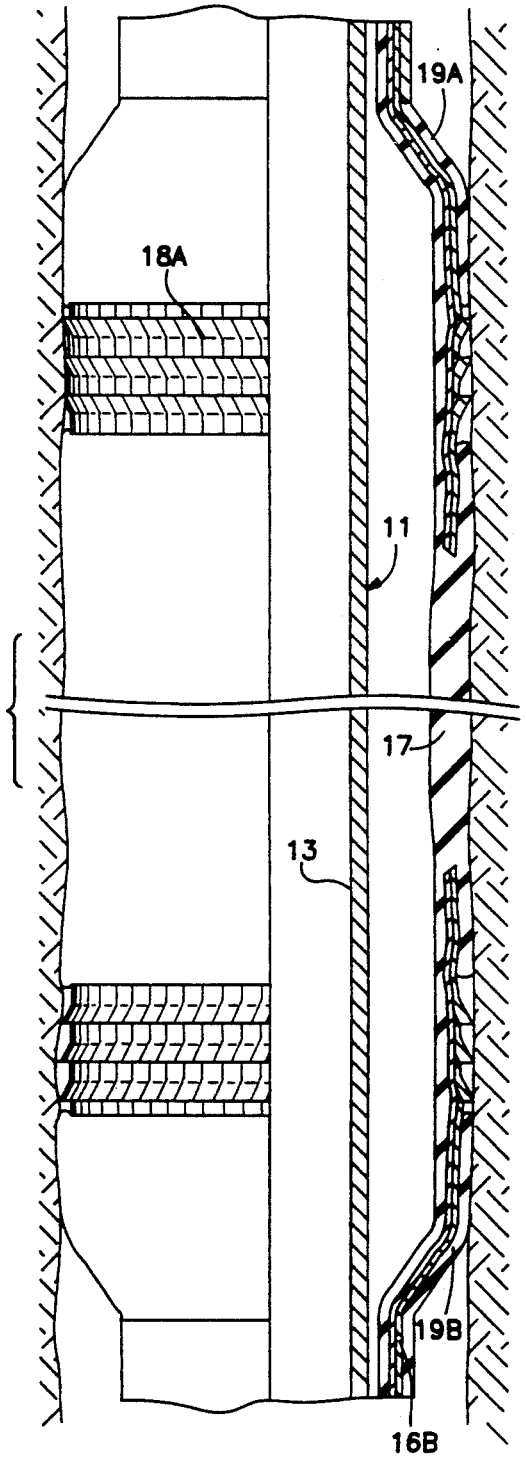
FIG. 3 is a view similar to FIG. 2 upon further inflation of the sleeve to move its mid portion and then grippers about upper and lower sets of its reinforcing strips into engagement with the well bore.

More particularly, the upper and lower strips 16A and 16B are provided with grippers 18A and 18B, respectively, for gripping the well bore, as the portions of the strips adjacent the outer layer 17 are moved outwardly into engagement with it upon continuing inflation of the sleeve, from the position of FIG. 2 to that of FIG. 3. These grippers may be of any suitable construction, including portions which are struck from the side edges of the strips, again as shown and described in the aforementioned U.S. Pat. No. 4,892,144. Thus, the grippers 18A are so formed as to resist upward movement, while the strips 18B are so formed as to resist downward movement, whereby each of the upper and lower portions of the sleeve are prevented from folding back over the mandrel as the sleeve is fully inflated.

Portions of the strips intermediate the heads and the grippers thereon are also surrounded by layers of elastomeric material. Thus, a layer 19A surrounds the intermediate portions of the metal strip 16A, and outer layer 19B surrounds the intermediate portions of the strips 16B. As shown, the outer diameters of the layers 19A and 19B are essentially equal to one another as well as the intermediate layer 17.

Figure 4:
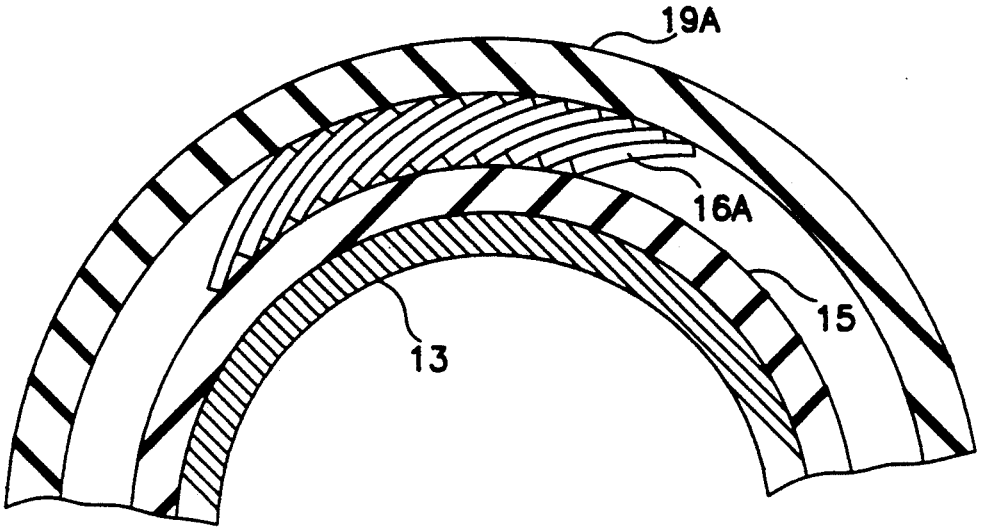
FIG. 4 is a partial cross-sectional view of the packer, on an enlarged scale, and showing the sleeve, reinforcing strips and a layer of elastomeric material about the strips, prior to inflation of the sleeve.
Figure 5:
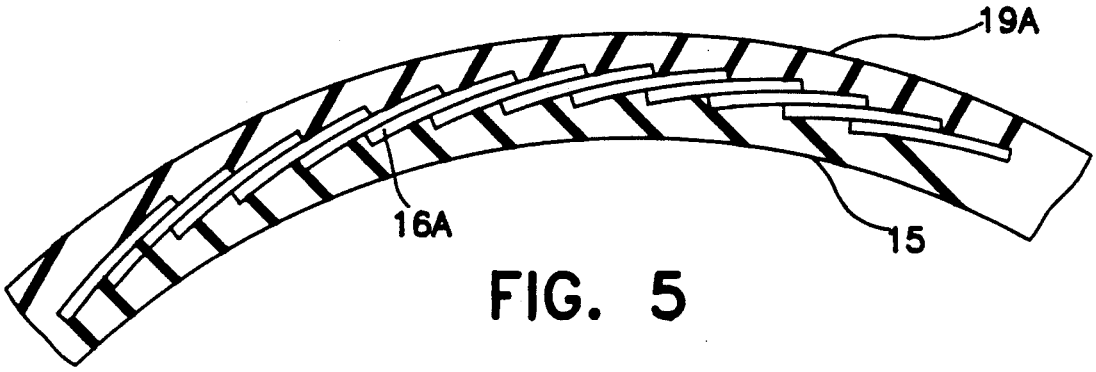
FIG. 5 is another view of the sleeve, strips and layer of elastomeric material upon inflation of the sleeve.

As shown in FIG. 4, prior to inflation of the sleeve, major portions of adjacent strips overlap with respect to one another. Consequently, as the sleeve is inflated, as shown in FIG. 5, the strips will maintain an overlapping relation so as to continue to reinforce the sleeve.

Although the sleeve may be inflated in any suitable manner, it is contemplated that, as shown, it would be inflated by means of fluid under pressure introduced into a passageway 20 in the upper sub connecting a side port 21 leading to the bore of the mandrel with the annular recess of the upper head. More particularly, as described in the aforementioned U.S. Pat. No. 4,892,144, the upper end of the sleeve is so anchored to the head as to confine the flow of fluid through the passageway 20 into the space between the mandrel and sleeve, and the lower end of the sleeve is similarly anchored to close the lower end of the space between the sleeve and intermediate portion of the mandrel, whereby the supply of fluid will cause the sleeve to expand.

As illustrated in FIG. 1A, the port 21 leading to the passageway 20 is normally closed by a knock-off plug 22 in the port 21, which extends into the bore of the mandrel in position to be sheared by a plug lowered through the casing string to open the port. As it continues to be pumped downwardly through the bore of the packer onto a seat in the casing string, the plug causes fluid to be diverted into the port.

Preferably, the fluid is supplied to the space between the sleeve and mandrel through valve means, indicated diagrammatically by the letter V, and installed in the passageway to open to permit the flow of fluid into the space to inflate the packer, and then close so as to retain the pressure in the space and thus maintain the packer expanded against the well bore. A valving arrangement suitable for this purpose is shown and described on page 28 of a brochure of Davis-Lynch, Inc., of Houston, Tex., published in 1991.

The fluid may be of any suitable type, such as drilling mud which has been circulated downwardly through the casing string prior to cementing of the string within the well bore. Alternatively, and as previously mentioned, it is contemplated that, in packers of this general type, the fluid may instead be cement. Furthermore, the packer may be provided with two or more passageways and control valves for increasing the cross-sectional area through which the fluid may be passed.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A packer for use in closing off the annulus between a casing string and a well bore in which the casing string is suspended, comprising a tubular mandrel adapted to be connected as part of the casing string and having a head at each end, a sleeve of elastomeric material surrounding an intermediate portion of the mandrel and anchored at its upper and lower ends to the upper and lower heads, respectively, means by which fluid under pressure may be introduced into the annular space between the mandrel portion and sleeve so as to inflate the sleeve into engagement with the well bore, upper and lower sets of substantially flat, relatively rigid, overlapping strips having their upper and lower ends, respectively, anchored to the upper and lower heads, and extending therefrom for disposal about only upper and lower portions of the sleeve, an outer layer of elastomeric material covering the free ends of the strips, and means on the outer surfaces of the uncovered portions of both sets of strips for gripping the well bore following inflation of the mid portion of the sleeve intermediate the free ends of the strips against the well bore, so as to prevent the upper and lower portions of the sleeve from being folded back over the ends of the mandrel.

2. A packer as described in claim 1, wherein said mandrel includes inner and outer tubular members which form an annular recess in the head in which the ends of the sleeve and strip are anchored, and layers of elastomeric material covering the strips between the upper and lower heads and their upper and lower uncovered portions.

3. A packer as described in claim 1, wherein the means by which the sleeve may be inflated includes a passageway in the mandrel connecting the bore of the mandrel with the annular space between an intermediate portion of the mandrel and the sleeve, and valve means in the passageway to permit fluid to flow into the space to inflate the sleeve and then hold fluid in the space to maintain the sleeve expanded.

* * * * *